United States Patent [19]

Lindell

[11] 4,245,493

[45] Jan. 20, 1981

[54] IMPACT PRESS

[76] Inventor: Lennart J. Lindell, 1859 Park Ave., Sycamore, Ill. 60178

[21] Appl. No.: 14,093

[22] Filed: Feb. 22, 1979

[51] Int. Cl.[3] ..... B21J 7/20

[52] U.S. Cl. ..... 72/436; 83/587; 173/124

[58] Field of Search ..... 72/436, 437, 434, 429, 72/421, 452; 173/124; 83/586, 587

[56] References Cited

U.S. PATENT DOCUMENTS

| | | | |
|---|---|---|---|
| 1,006,873 | 10/1911 | Phillips | 72/452 |
| 1,053,744 | 2/1913 | Phillips | 72/452 |
| 1,221,421 | 4/1917 | Crosiar | 72/437 |
| 1,465,918 | 8/1923 | Redinger | 72/437 |
| 1,747,842 | 2/1930 | Phillips | 72/437 |
| 2,245,879 | 6/1941 | Sossner | 72/437 |
| 2,641,941 | 6/1953 | Lundeberg | 72/436 |
| 3,854,356 | 12/1974 | Okreglak | 83/587 |
| 3,906,828 | 9/1975 | Suzuki | 83/587 |

FOREIGN PATENT DOCUMENTS

| | | | |
|---|---|---|---|
| 195625 | 2/1908 | Fed. Rep. of Germany . | |
| 1122460 | 1/1962 | Fed. Rep. of Germany . | |
| 1099458 | 3/1955 | France . | |
| 592462 | 9/1947 | United Kingdom . | |
| 561597 | 7/1977 | U.S.S.R. | 72/434 |

*Primary Examiner*—Francis S. Husar
*Assistant Examiner*—Gene P. Crosby
*Attorney, Agent, or Firm*—Hill, Van Santen, Steadman, Chiara & Simpson

[57] ABSTRACT

An impact press includes drive means for reciprocating a sleeve at one end of which a ram is slidably and rotatably carried, the same being normally held in a retracted position by retaining means. The drive means that reciprocates the sleeve toward and away from impact tooling also regulates in synchronization therewith a releasing means by which the retaining means lets go of the ram to permit it to fly under the influence of a bias until it impacts the tooling. Reaction from the tooling after the punching has been completed provides a force for receiving the ram in the sleeve. If desired, the driving means can also be used to regulate the operation of a workpiece feeder, a workpiece brake, and any regulator that the impact tooling may have, all in synchronization with the movements of the sleeve. If a conventional air feeder is used, owing to limitations of the feeder, the device can be operated at 180 strokes per minute. Without such feeder smaller workpieces can be made or modified at the rate of 500 strokes per minute.

22 Claims, 17 Drawing Figures

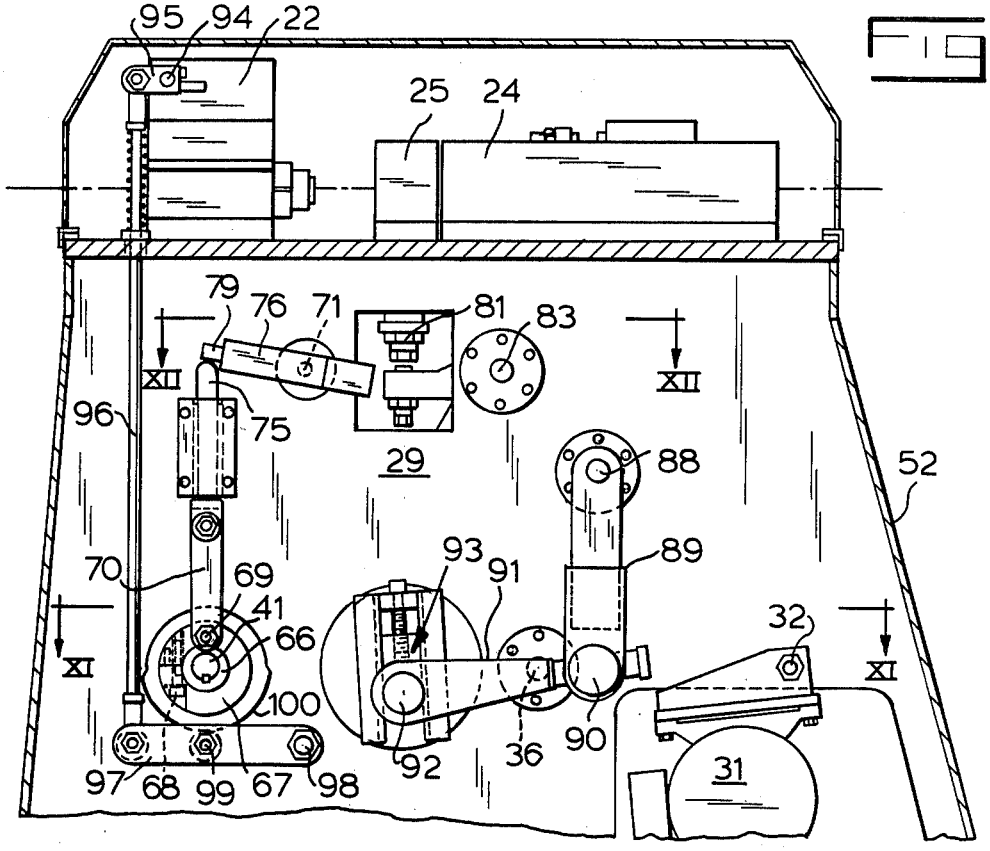
FIG 9
FIG 10
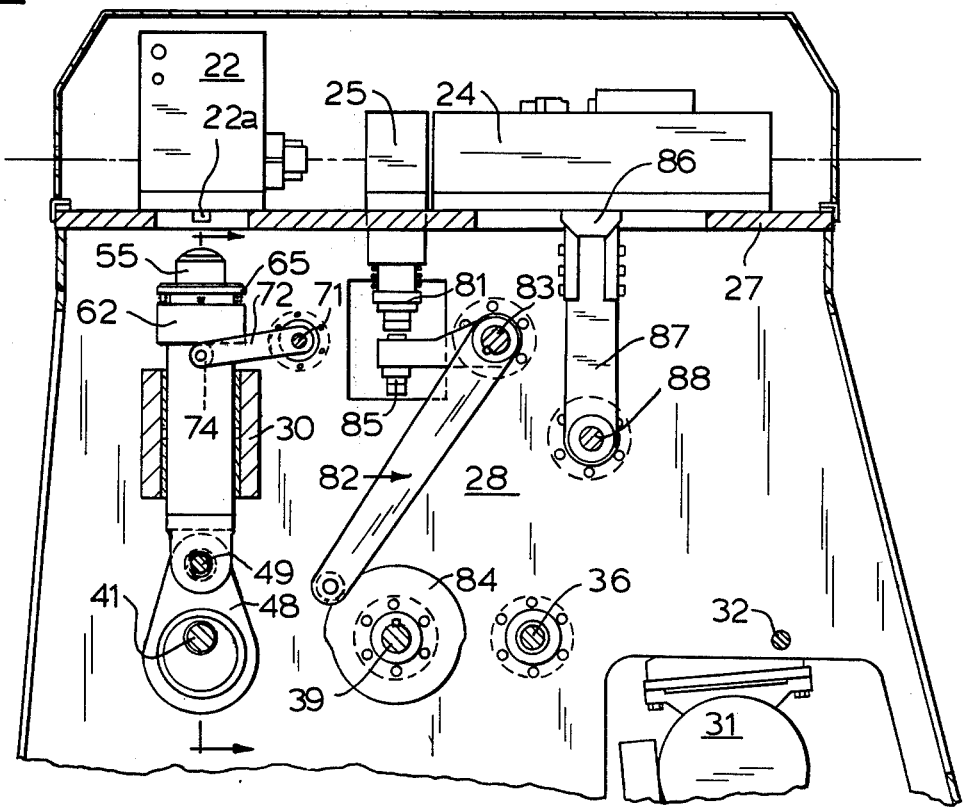

IMPACT PRESS

BACKGROUND OF THE INVENTION

1. Field of the Invention

This invention relates to a machine tool referred to herein as an impact press in that the workpiece-modifying-energy is imparted to the tooling with a substantial impact.

2. Prior Art

In a prior device energy has been obtained from a pneumatic system to drive the press ram along a path until it collides with or impacts against the tooling. One difficulty with such a construction is that its capacity was limited. For example, when used with cut-off tooling, the maximum thickness of steel that it could cut was ¾ inch. Further, such device lacks the ability to utilize tooling which involves controlled forming, for example, compound tooling that would either blank or cut off a workpiece and form it in the same stroke. One practical reason for not building such pneumatically operated device in larger sizes is that the size of the pneumatic components needed would be so big that they would not be commercially available, and thus the cost of such a device would be so high that it would offset the advantages of the use of this type of press.

SUMMARY OF THE INVENTION

The present invention is directed to an impact press wherein a hollow sleeve is reciprocably driven, there being a ram slidable within the sleeve which is normally retained therein during sleeve reciprocation. However, means are provided for releasing the retaining means at a predetermined point during the reciprocation of the sleeve toward the tooling, whereby the ram is released to move freely in a guided path until it impacts against the tooling. Continued reciprocation of the sleeve is used to recapture the ram as held by the retaining means. The amount of free travel that the ram has can be reduced selectively for use with lighter gauge materials.

Accordingly, it is an object of the present invention to provide an impact press for use with impact responsive tooling.

Another object of the invention is to provide a structure that can be readily fabricated in larger sizes to enable the provision of impact presses without entailing excessive cost and space requirements.

Another object of the present invention is to provide an impact press that can be used with tooling that has a forming capacity, even though its most common usage would involve metal cutting.

Many other advantages, features and additional objects of the present invention will become manifest to those versed in the art upon making reference to the detailed description and the accompanying sheets of drawings in which a preferred embodiment incorporating the principles of the present invention is shown by way of illustrative example.

ON THE DRAWINGS

Figure 1:
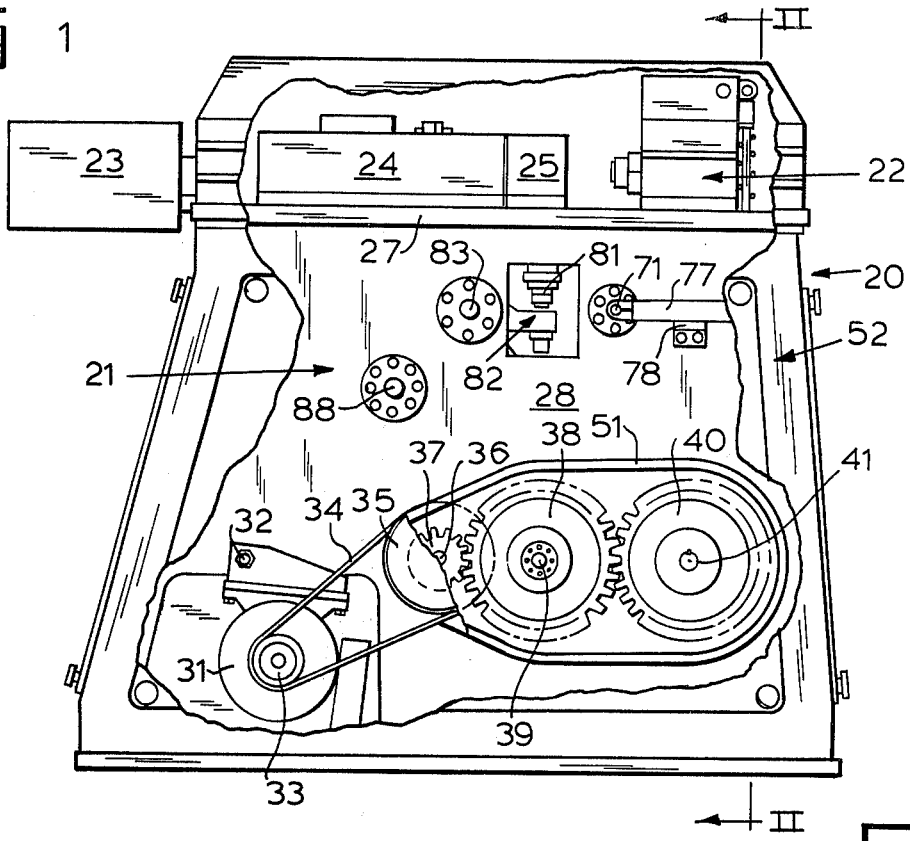
FIG. 1 is a side elevational view, with part of a housing broken away, of an impact press constructed in accordance with the present invention.
Figure 4:
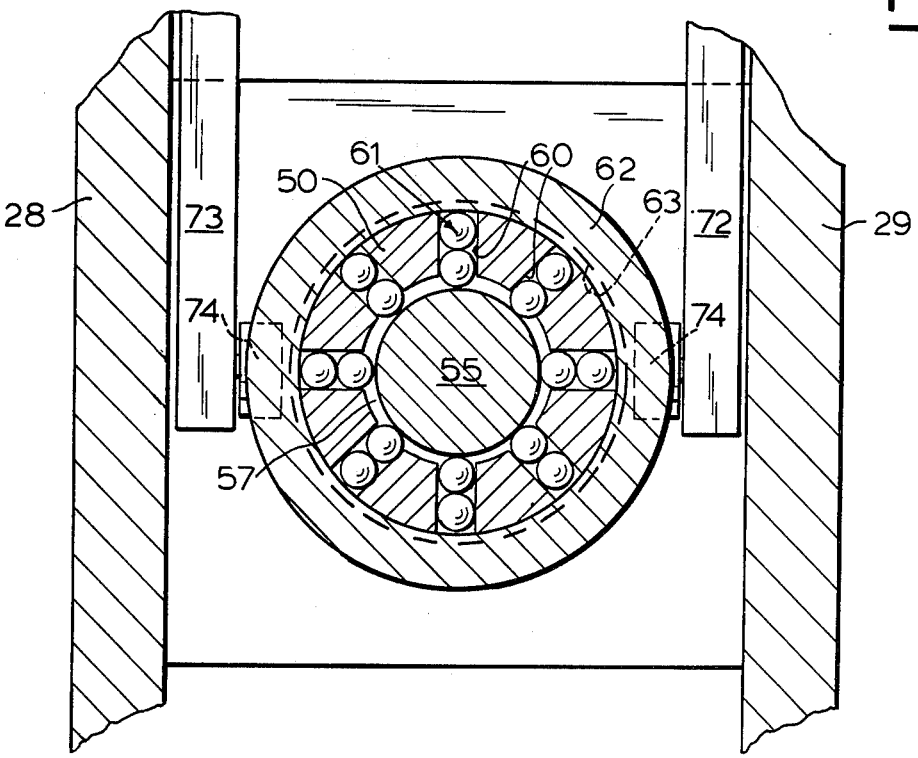
Figure 3:
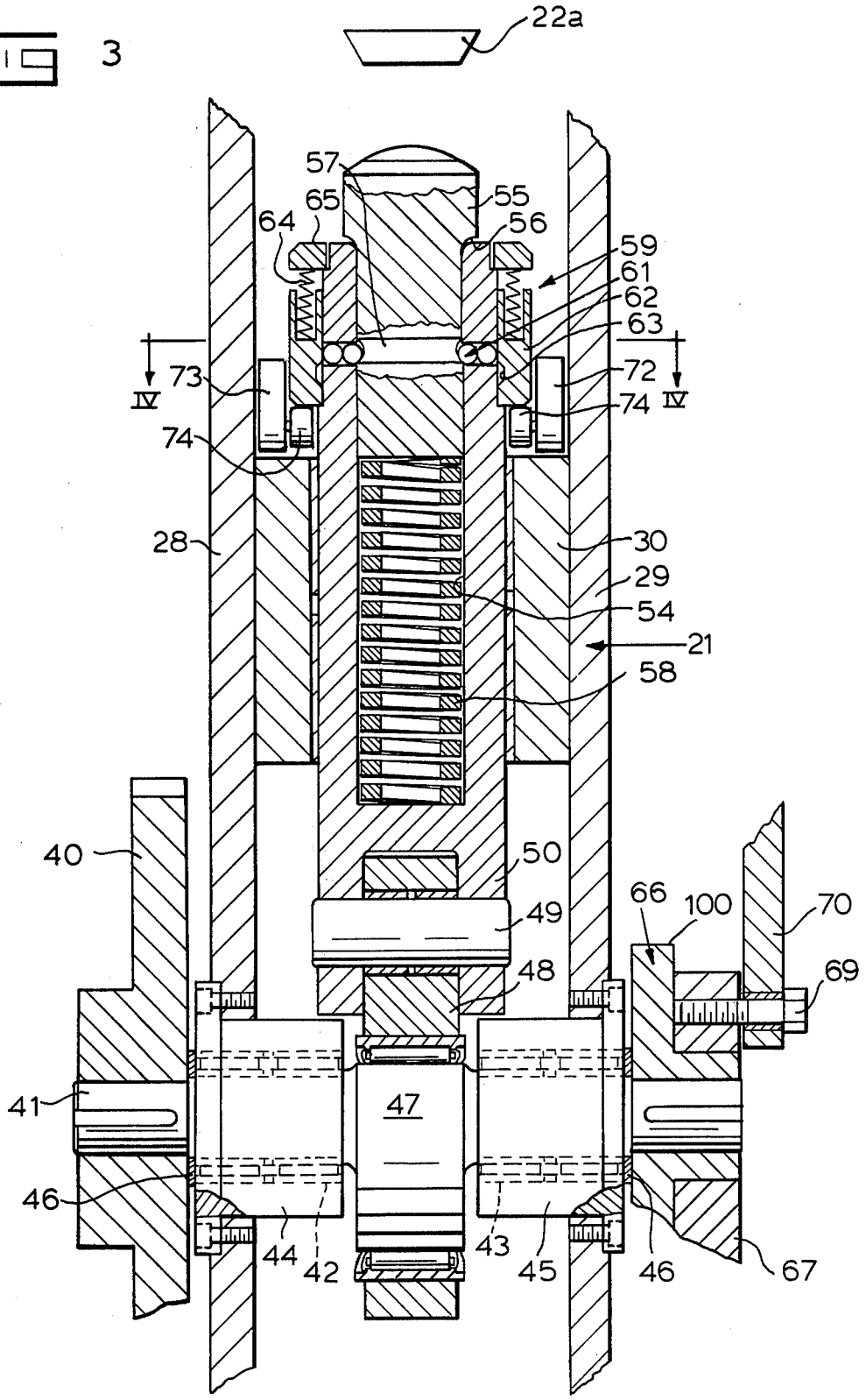
FIG. 3 is an enlarged fragmentary portion of FIG. 2 with additional components shown in cross-section.
Figure 11:
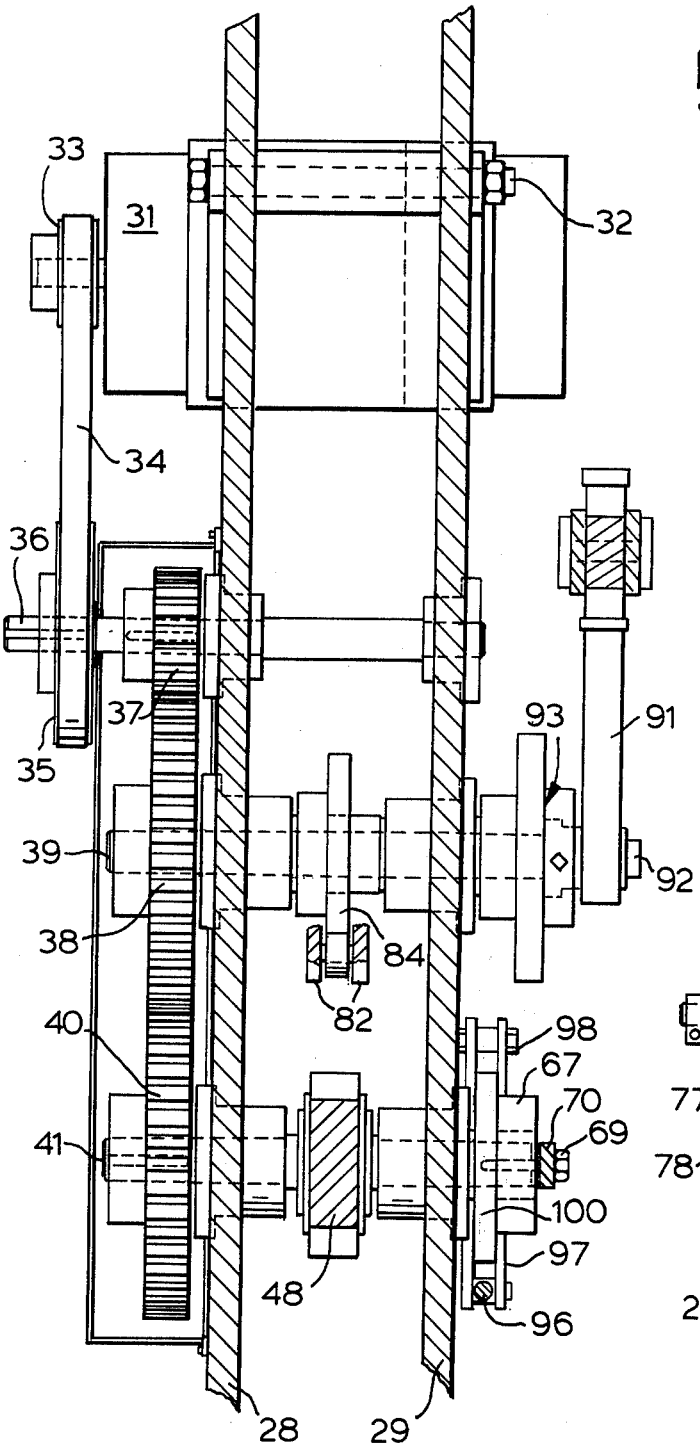
Figure 12:
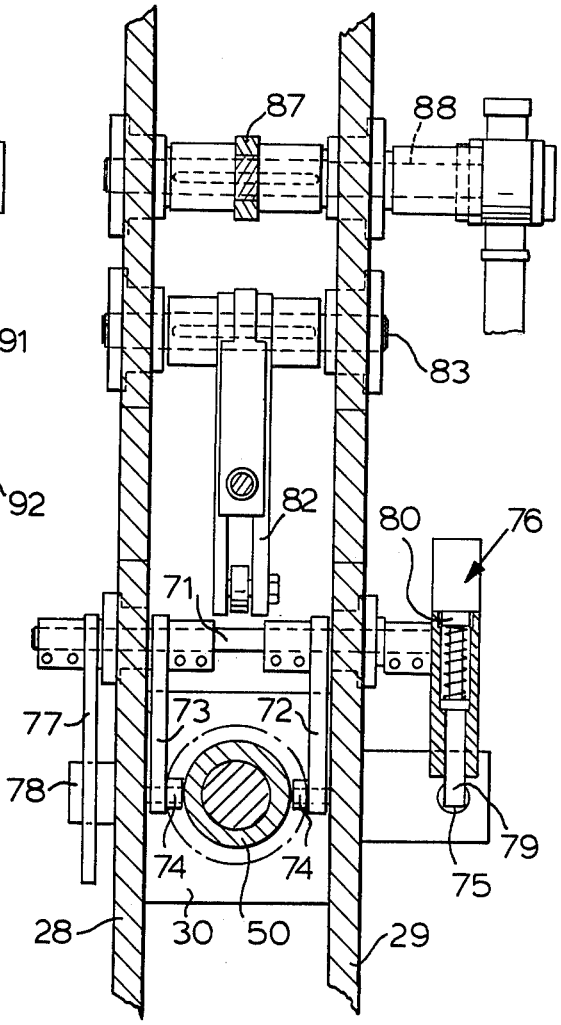
Figure 13:
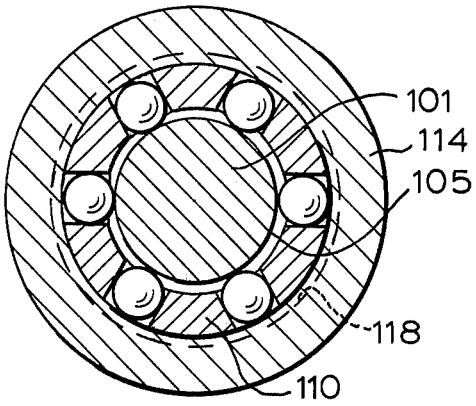
Figure 14:
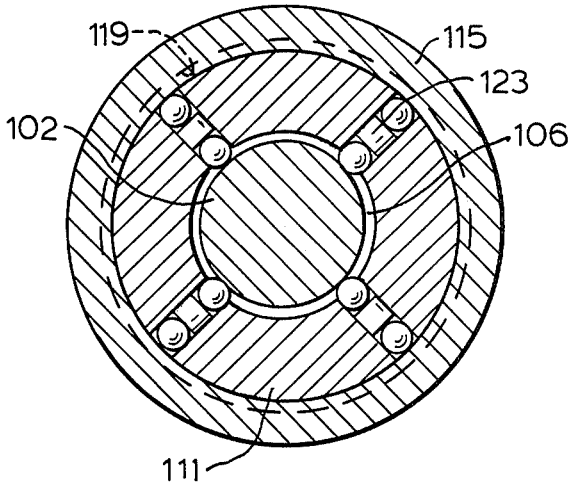
Figure 15:
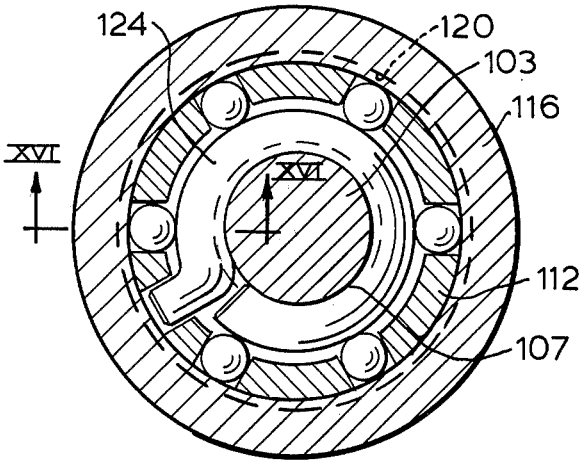
Figure 16:
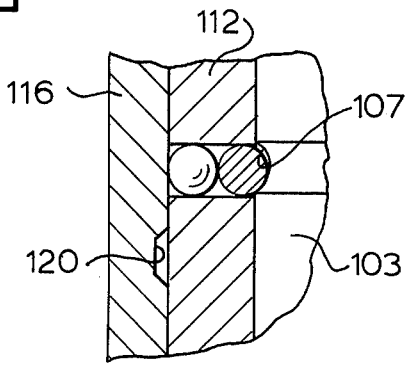
Figure 17:
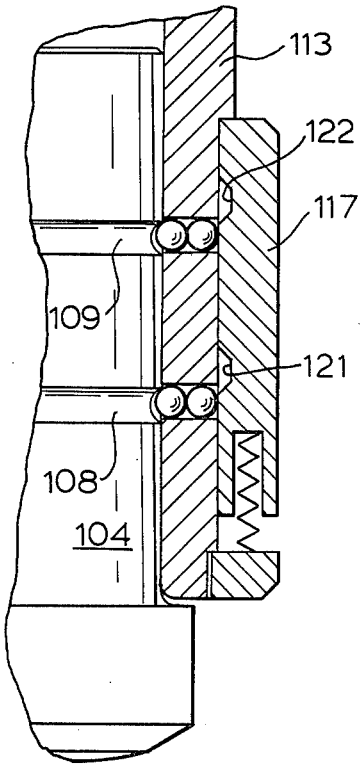

FIG. 4, shown with FIG. 1, is a further enlarged horizontal-sectional view taken along line IV—IV of FIG. 3;

FIGS. 5–8 correspond to a portion of FIG. 3 and illustrate various relationships that take place in one operating cycle;

FIG. 9 is a vertical view with parts of the housing and frame shown in cross-sectional and taken from the side of the press opposite to that shown in FIG. 1;

FIG. 10 is a vertical cross-sectional view taken substantially along the longitudinal center of the machine;

FIG. 11 is a fragmentary horizontal cross-sectional view taken along line XI—XI of FIG. 9;

FIG. 12 is a similar view taken along line XII—XII of FIG. 9;

FIGS. 13 and 14 are constructions that are alternates to that shown in FIG. 4;

FIGS. 15 and 16 show a further alternate construction, the latter being taken along line XVI—XVI of FIG. 15; and FIG. 17 is a further alternate to that shown in the upper part of FIG. 3, but illustrated inverted therefrom.

AS SHOWN IN THE DRAWINGS

An impact press constructed in accordance with the present invention is illustrated in FIG. 1, and is generally indicated by the numeral 20. The illustrated press includes a frame 21 which supports a selected tooling assembly 22 which includes appropriate structure for modifying a workpiece, such as blanking, cut-off, forming or a combination thereof. If desired, a straightener 23 may be carried on the frame 21 to straighten any strip or wire which then passes to a feeder 24 and to a workpiece clamp or brake 25.

The structure that operates the tooling 22, the straightener 23, the feeder 24 and the brake 25 is shown in the other views.

Figure 2:
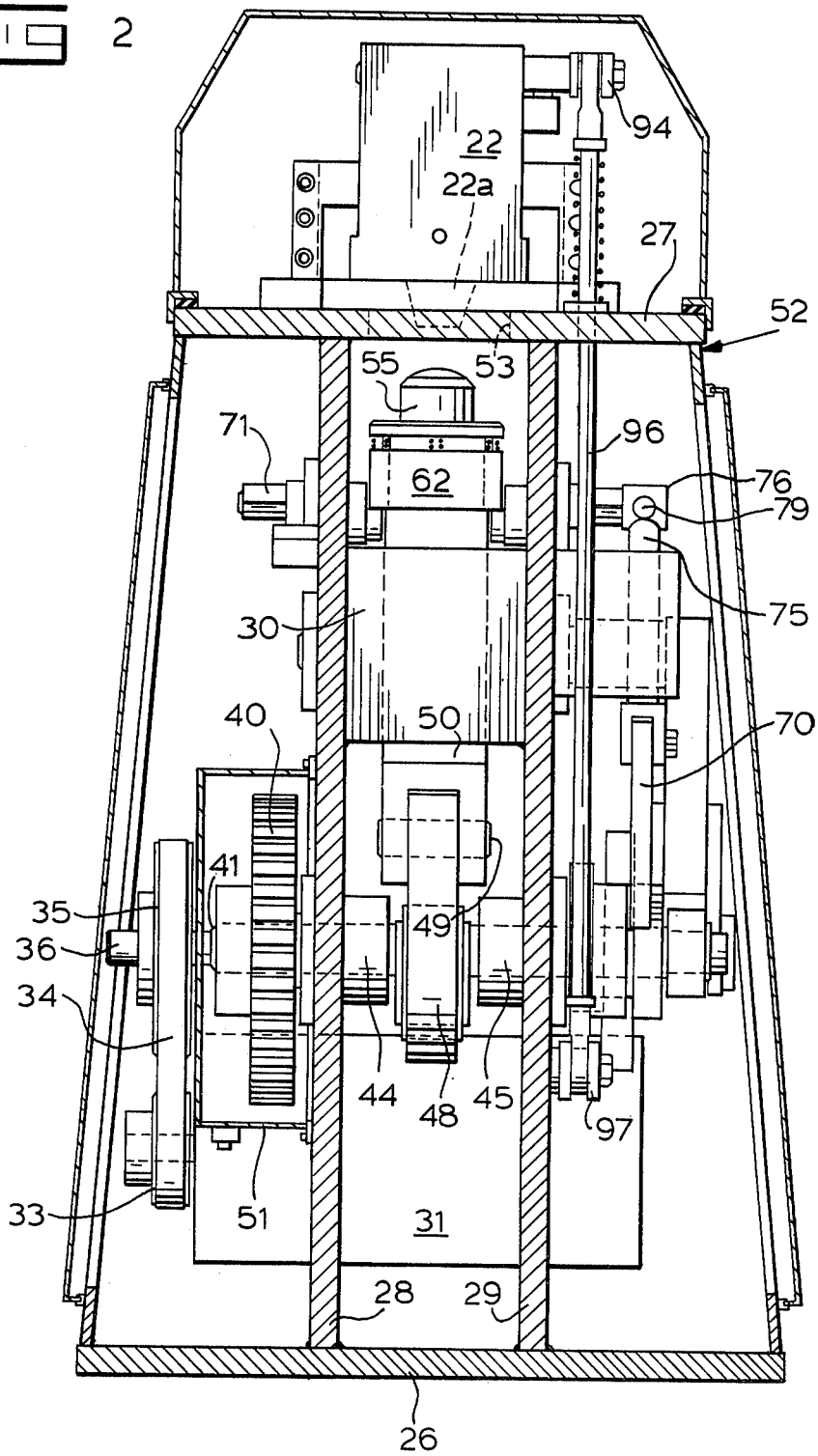
FIG. 2 is an enlarged vertical cross-sectional view taken along line II—II of FIG. 1.

As best seen in FIG. 2, the frame 21 includes a base plate 26 on which the impact press 20 is supported, a cap plate 27 on which the tooling 22 and other accessories are supported, and a pair of spaced vertical side plates 28, 29, there being a guide block 30 therebetween.

As best shown in FIGS. 1 and 2, a motor 31 is pivotally supported on a rod 32 and has an output pulley 33 connected by a belt 34 to a driven pulley 35 which is drivingly supported on a shaft 36 which corotatably carries a gear 37 which meshes with a gear 38 on a shaft 39 which meshes with a gear 40 which is secured to a crankshaft 41. The gear train is also shown in FIG. 11 from above.

The crankshaft 41 is supported by two sets of needle bearings 42, 43, each of which has an inner race that directly engages the shaft 41 and an outer race received in a pair of flanged tubular bearing supports 44, 45, respectively secured to the frame walls 28, 29. A pair of bearing washers 46, 46 separate the gear 40 from the bearing support 44 and the bearing support 45 from a hub described below. The driven crankshaft 41 has an eccentric 47 which is connected to a connecting rod 48 which is connected by a pin 49 to a sleeve 50 which is slidably and reciprocably guided in the guide block 30 of the frame 21. The connecting rod 48 is provided with appropriate bearings at the eccentric 47 and at the pin 49, and the guide block 30 is likewise provided with appropriate sleeve bearings as shown. The gears 37, 38 and 40 are containd within a sealed gear casing 51 best shown in FIGS. 1 and 2. The pulley 35 and gear 37 reduce the effective speed of the motor 31, and the gears 38 and 40 are of the same size, so that their rotation is in sychronization but of opposite direction.

With the cap plate 27 substantially at waist height, the space there-beneath will accommodate structure up to a certain size. The illustrated arrangement is compact and the structure is enclosed by a housing 52 which has a removable cover on each of its four sides and a removable cover that encloses the tooling assembly 22. The tooling assembly 22 has a downwardly directed portion 22a which projects into an opening 53 which is in alignment with the sleeve 50.

If it is desired to be able to handle workpiece material of a heavier gauge so that not enough power could be developed in the space illustrated, then the driving means for the sleeve 50 is placed above the frame plate 27, and there is virtually no limit as to how large the structure might be thereabove. In that instance, the sleeve 50 would be reciprocated downwardly to the tooling assembly rather than upwardly to it as shown in the drawings.

The sleeve 50 is axially hollow and in its bore 54, there is disposed a ram 55 which is slidably and rotatably carried therein. The ram 55 has an axially facing shoulder 56 which is engageable with the end of the sleeve 50, and this engagement substantially defines a retracted position of the ram 55 within the sleeve 50. In this embodiment, the ram 55 is biased by a helical compression spring 58 which acts between the sleeve 50 and the end of the ram 55. The ram 55 has a peripheral groove 57 which forms a part of retaining means described below. When the retaining means are released, the ram 55 is free to move and responds to its inertia of movement and/or bias and the only structure that will arrest such movement is the portion **22*a*** of the tooling assembly which thus substantially defines the extended position of the ram where impact occurs.

In certain types of operations, the spring 58 can be omitted and the inertia present in the ram 55 due to reciprocation will suffice. Also, other structure for storing energy may be used in place of the spring 58. However, the spring 58 has an unusual or unexpected advantage. In that it is a coil spring, on compression and extension, there is a tendency for the one end to turn with respect to the other, and this torque is applied to the ram. In one observation, it was noted that the ram 55 made one complete revolution in 40 strokes, so there is thus incremental rotation on the order of 9 degress per stroke. Such rotation of the ram is advantageous because the end surface maintains a uniform profile during use.

The sleeve 50 and the ram 55 jointly support retaining means generally indicated at 59. The retaining means includes the peripheral groove 57, a number of radial apertures 60 in the sleeve 50, each containing retainer means 61, a portion of which is moveable into the peripheral groove 57 when the peripheral groove 57 is in registration with such retainer means 61. The retainer means 61 in this embodiment includes pairs of spaced balls, there being other embodiments described below. The retainer means 59 further includes a locking ring 62 which is adapted to control the release of the ram 55. To that end, the locking ring 62 has an inner peripheral groove 63 which surrounds the sleeve 50, the locking ring axially slidable on the sleeve and also being capable of rotating on the sleeve. The locking ring 62 is axially biased so that the groove 63 in the ring 62 is urged axially away from the retainer means 61, the bias in this instance being provided by a set of springs 64 which act between a threaded ring 65 carried on the end of the sleeve 50 and the locking ring 62. The bias provided by the spring 58 against the ram 55 urges the edge of the peripheral groove 57 against the retainer means 61, thus biasing the retainer means radially outwardly, but the retainer means 61 is held axially locked by the locking ring 62. When the locking ring 62 is shifted axially to place the inner groove 63 in registration with the retainer means 61, the force from the ram groove 57 moves the retainer means radially outwardly and when the grooves are in registration, the ram is axially released.

The magnitude of the eccentric 47 determines the travel of the sleeve 50. The point in the cycle where the retaining means 59 is released determines the amount of travel that the ram 55 will be permitted to have as it approaches the tooling portion **22*a***.

Figures 5, 6, 7, 8:
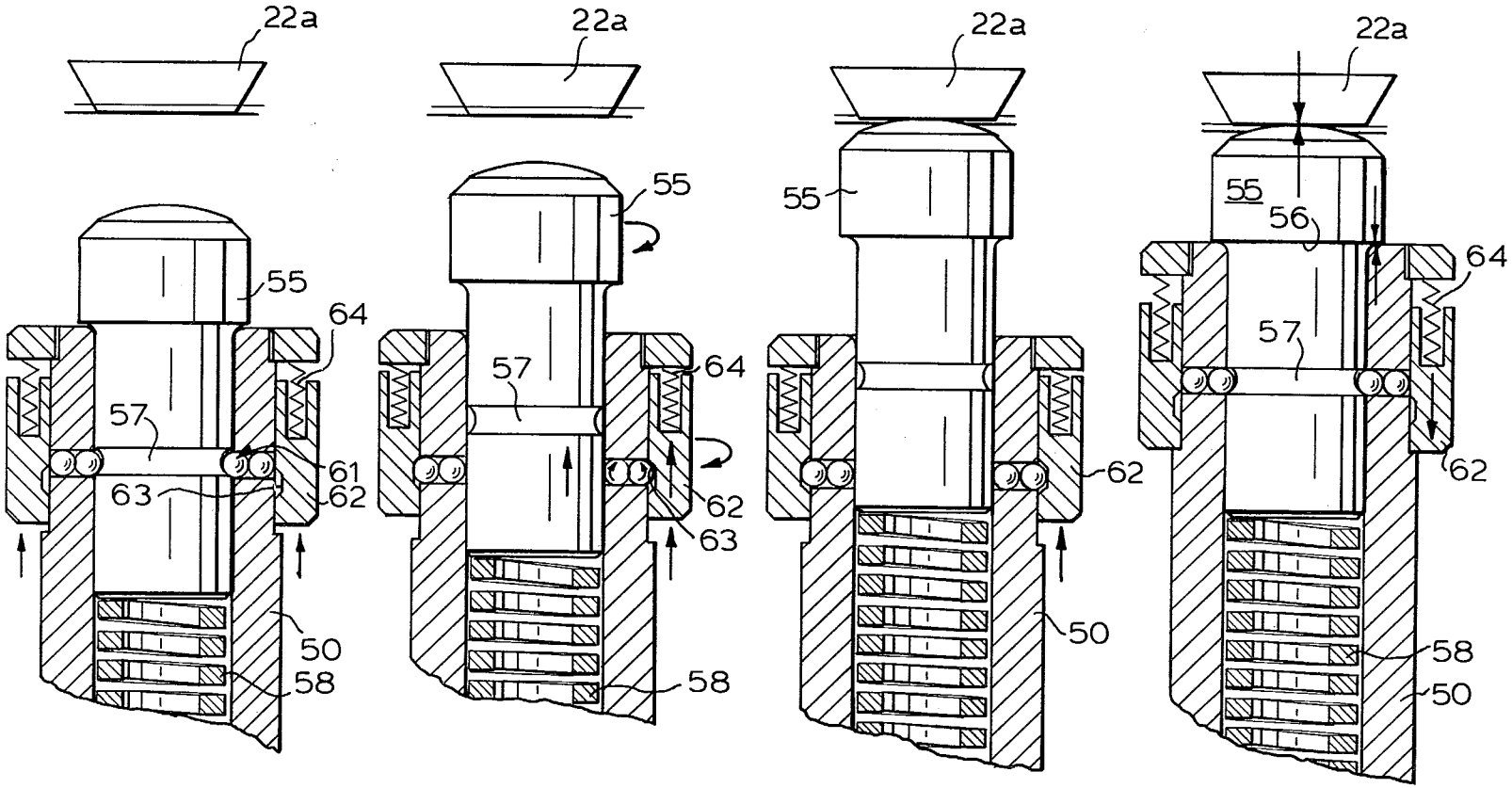

With reference to FIG. 5, just before ram release is to take place, a force is applied by releasing means, described below, in the direction of the arrows against the locking ring 62. This force is opposed by the springs 64 which thus store energy therein. As soon as the ring groove 63 registers with the retainer means 61, the spring 58 expands as shown in FIG. 6 and the ram begins to approach the tooling portion **22*a*. It does so at an extremely high velocity. When the spring 58 is thus biasing the released ram 55 to move, the spring 58 also applies a torque to the ram 55, causing it to turn. At that same moment, the springs 64 act on the locking ring 62 so that the edge of the groove 63 urges the balls of the retainer means 61 endwise against the shank of the ram 55. The ram 55 causes the balls that engage it to rotate along with the surface of the ram, and one ball causes the next one to rotate. However, the rotation of the ram 55 about its axis also causes the balls of the retainer means 61 to have a movement about a vertical axis, the one transmitted to the next and that one transmitting its movement to the ring 62, thus also imparting a slight angular movement to the ring 62. The force is sufficient so that the springs 64 do not prevent such movement. The advantage of this movement is that not only is there no Brinelling by the balls in the groove 57 but there is no Brinelling in the ring groove 63** either, thus the surfaces of these grooves being kept smooth in spite of repeated and extensive use.

In association with the tooling portion **22*a*, there have been provided a pair of reference lines, the lower ones representing the location of the tooling surface before impact. One impact takes place, such as shown a moment later in FIG. 7, the tooling 22*a* moves a small amount at a very high speed. The more brittle that the workpiece is the less travel is needed, but the travel here illustrated is representative. It may be assumed that shearing is just taking place with the parts arranged as shown in FIG. 7. Typically, a backup (not shown) is provided for the tooling portion 22*a* so that it is not free to move any further than to the second or upper reference line. However, the crankshaft 41 continues to shift the sleeve axially so that even though ram travel is substantially completed in FIG. 7, the sleeve travel continues. At this point, the releasing force can be removed from the locking ring 62, but the presence of the shank of the ram against the balls will still hold the ring 62 in the position illustratedin FIG. 7. This condition continues to remain until the sleeve 50 has moved its retainer means 61 to a point where the retainer means 61** once more become aligned with the ram groove 57. Substantially at that time, as shown by the upper arrows, the ram 55 can move no further because of reaction from the tooling assembly, and the shoulder 56 on the ram actually engages the end of the sleeve 50. With this condition present, the springs 64 are free to expand and thus the ring 62 is moved back to its fully retracted position, preparatory to the next stroke. As soon as the ram 55 has been so locked, the sleeve 50 resumes its travel in the opposite direction, and the spring 58 expands slightly to provide a rather slight gap at the ram shoulder 56 as shown in FIG. 5 and in FIG. 3 so that the retainer means 61 acts on the lower edge of the ram groove 57.

It is permitted to begin applying a force to locking ring 62 such as shown by the arrows in FIG. 5 before the sleeve 50 is at the remote end of its travel so that there can be some movement of the locking ring, almost to the point of ram-release, before the sleeve begins its movement toward the tooling. On the other hand, if the ram 55 is quite close to the tooling before there is ram release, than a smaller amount of the stored energy will be utilized, and a smaller amount of work will be necessary to effect relatching of the ram in its retracted position within the sleeve 50.

As used herein, releasing means refers to structure on the frame for releasing the retaining means 59, and such structure is found in several of the views. The releasing means is best shown in FIGS. 9 and 10. The crankshaft 41 is provided with a hub 66 keyed thereto and a radially split eccentric 67 is clamped to the hub 41 by means of an appropriate pin and screw arrangement 68. The eccentric 67 functions as such as it carries an eccentrically located screw 69 to which is connected a connecting link 70. A control shaft 71 is secured to and supported by bearings in the frame walls 28, 29, there being at least one release arm 72, 73 extending radially from the control shaft 71. As best seen in FIG. 12, each of the release arms 72, 73 has a roller 74 engageable with the lower end surface of the locking ring 62. The structure for transferring movement from the link 70 to the control shaft 71 is best shown in FIG. 9. The connecting link 70 is connected to a plunger 75 which engages an end of a drive arm 76 which is carried on the control shaft external to the frame wall 29. As the main eccentric on the crankshaft 41 controls and determines the axial position of the sleeve, and as the further eccentric 67 can be clamped on to the hub at any selected angular position, the drive arm 76 thus rocks the control shaft 71 at a selected time which is picked in relation and thus in response to the axial position of the sleeve 50.

On the other end of the control shaft 71, namely the left end shown in FIG. 12, there is a handle 77 and a stop 78, the handle being secured to the shaft 71. The handle or lever 77 engaging the stop 78 limits the amount that the rollers 74, 74 can move downwardly away from the locking ring 62. The lever or handle 77 can also be utilized as a manual actuator in connection with setting the desired position of the eccentric 67 of the releasing means.

Also, occasions do arise where it is desired to inhibit punching for cutting. Such result is obtained with the present device by selectively disabling the releasing means by in effect disconnecting the release arms 72, 73 from their source of power. In this embodiment, the drive arm 76 includes a pin 79 which is spring loaded and which is slidable therein. A solenoid 80 can be energized to effect retraction of the pin 79. When this happens, the drive arm 76 will not fall counterclockwise as viewed in FIG. 9 because the lever 77 on the other end of the control shaft 71 supports it. At the same time, when the eccentric moves upwardly to the position illustrated, which in FIG. 9 indicates a fully released locking ring, the plunger 75 will merely pass by the end of the drive arm 76 for whatever number of strokes that the solenoid was energized and hence for the number of strokes that the releasing means was disabled. Thus, retraction of the pin 79 inhibits the ram release.

The driving means on the frame also includes driving structure for coordinating the feeder 24 and the workpiece brake 25. The feeder 24 may be of conventional construction and it grips a workpiece, advances it, releases the grip on the workpiece, and then returns to the place from which it came to regrip the workpiece. In order that workpiece feed may be precise, the workpiece brake is preferably held actuated so that the workpiece cannot move during the time that the feeder 24 is disengaged to move back to regrip the workpiece.

The workpiece brake is shown schematically at 25 in FIG. 9 and it has a spring-loaded plunger 81. There is a linkage provided to actuate the brake 25 in coordination with the movement of the ram. The shafts 39 and 41 are driven at the same speed and are synchronized with each other by the gears 38, 40. Carried on a central portion of the shaft 39 is a bellcrank 82 pivoted on a shaft 83. One arm of the bellcrank 82 is in registration with the plunger 81 and the other or lower arm of the bellcrank 82 has a roller that follows the periphery of a cam 84 which is keyed to the shaft 39. An adjusting screw 85 determines the amount of travel that will be imparted to the plunger 81 to allow for various thicknesses of workpiece.

The feeder 24 is also actuated in synchronization with the movement of the sleeve 50 and is driven by the shaft 39. As shown in FIG. 10, a reciprocable portion 86 projects through a slot in the frame plate 27 and has a sliding connection with an arm 87 pivotally carried on a shaft 88. When the shaft 88 is rocked, the feeder is thus reciprocated horizontally. The shaft 88 projects toward the viewer in FIG. 10 through the wall 29, and on the outer end, the shaft 88 carries a downwardly extending arm 89 pivotally connected at 90 to a further arm 91 which has a pivotal connection 92 with an adjustable cross-slide 93 which is carried on the end of the shaft 39 as best shown in FIG. 11.

The tooling assembly 22 may have a feature which also requires coordination with the other parts of the machine. It is so assumed in the present instance, and it is further assumed that appropriate control or regulation can be provided by appropriate rocking of a shaft 94. A lever 95 is clamped thereto and a connecting rod 96 of adjustable effective length is pivotally connected to the lever 95 and to one end of a further lever 97, the latter being pivoted to the frame at 98. The lever 97 supports a roller 99 which functions as a cam follower in engaging a cam surface 100 which may form the outer periphery of the hub 66. Thus any regulation of the tooling is carried out in synchronization with the movements of the sleeve 50.

Motor 31 operating through the belt-and-gear drive rotates the crankshaft 41 to reciprocate the sleeve 50. This same crank shaft also regulates and drives the releasing means which are engageable with the locking ring at a selected point in the cycle of operation to release the locking ring, thereby freeing the ram to impact against the tooling. Continued rotation of the crankshaft removes the force needed to operate the locking ring and continued advancement of the sleeve toward the tooling causes the ram to be recaptured in its retracted position in the sleeve, owing to the reactive force from the tooling. Appropriate linkages driven by the same gearing reciprocate the feeder, actuate the workpiece brake, and regulate the tooling if necessary.

There are other constructions of retaining means that are contemplated depending upon the size and capacity being designed into the impact press. FIGS. 13–17 illustrate some further retaining means. Each of these uses a ram 100-104 that has therein a peripheral groove 105-108, the ram 104 having a second peripheral groove 109. These modifications each include a sleeve 110-113 with radial apertures that receive various retainer means therein. Each of these embodiments has a locking ring 114-117 adapted to control the release of the ram, each having an inner peripheral groove 118-121, the locking ring 117 having a second inner periheral groove 122. The peripheral grooves 108 and 121, and 109 and 122 respectively move into registration at the same time. In these modifications, the retainer means 61 in each instance includes balls, in FIGS. 14 and 17 they include pairs of balls, in FIG. 14 they include spacer pins 123 between pairs of balls, and in FIG. 15 there is a locking ring 124 which can exert a very powerful grip on the ram since there is line contact virtually the entire circumference of the ram 103.

Where compound tooling is utilized, the various adjustments described above can enable a slightly different operation. After the ram 55 has been released and has impacted against the tooling as shown in FIG. 7, continued advance of the sleeve 50 causes the end thereof to engage the shoulder 56 of the ram as shown in FIG. 8. If at this time the sleeve 50 has not yet reached its limit of travel, continued advance (upwardly in FIG. 8) can be utilized to perform added work, by compound tooling, on the workpiece. Such driven overtravel thus involves direct drive of the ram 55 by the driving means.

With a conventional air-driven feeder 24, the impact press is limited in rate of operation to about 180 strokes per minute. Without such a feeder, smaller workpieces can be made or modified at a normal rate of 500 strokes per minute.

Although various minor modifications may be suggested by those versed in the art, it should be understood that I wish to embody within the scope of the patent warranted hereon, all such embodiments as reasonably come within the scope of my contribution to the art.

I claim as my invention:

1. An impact press, comprising in combination:

(a) a frame adapted to support a tooling assembly for modifying a workpiece;

(b) a reciprocably driven sleeve slidably guided on said frame for movement toward and away from the tooling assembly;

(c) a ram slidable in and guided only by said sleeve between a retracted position with respect to said sleeve and an extended position of impact with a portion of the tooling assembly;

(d) means carried on said sleeve and extending therethrough to said ram for releasably retaining said ram in said retracted position; and (e) power driven means carried on said frame for releasing said retaining means at a predetermined point during the reciprocation of said sleeve toward the tooling assembly.

2. An impact press according to claim 1, said ram having a peripheral shoulder engageable axially with said sleeve and substantially defining said retracted positon during such engagement.

3. An impact press according to claim 1, including means for selectively disabling said releasing means.

4. An impact press according to claim 1, including means carried on said frame for reciprocably driving said sleeve and for actuating said releasing means in synchronism therewith.

5. An impact press according to claim 4, said driving means including a further linkage adapted to be connected to the tooling assembly.

6. An impact press according to claim 4, said driving and actuating means including:

(a) a driven crankshaft supported on said frame;

(b) a connecting rod acting between an eccentric on said crankshaft and said sleeve; and (c) a connecting link acting between a further eccentric on said crankshaft and said releasing means.

7. An impact press according to claim 4, said driving means including a first linkage for actuating a reciprocable feeder for the workpiece by an adjustable amount.

8. An impact press according to claim 7, said driving means including a second linkage for actuating a workpiece brake during retraction of the feeder by an adjustable amount of actuation.

9. An impact press according to claim 1 including a spring at all times fully disposed in said sleeve and acting between said sleeve and said ram, and in which energy is stored when said ram is in said retracted position.

10. An impact press according to claim 9, said ram being rotatable within said sleeve, said spring being a helical compression spring imparting an increment of rotation to said ram during its expansion.

11. An impact press according to claim 1, said retaining means including:

(a) a peripheral groove on said ram within said sleeve;

(b) retainer means carried in said sleeve and a portion of which is movable into said peripheral groove when the same are in registration with each other;

(c) a locking ring having an inner peripheral groove surrounding said sleeve, said locking ring being axially slidable on said sleeve;

(d) said peripheral groove on said ram urging said retainer means radially outwardly, but being held axially locked by said locking ring; and (e) said ram being axially released from said sleeve when said power driven releasing means has moved said grooves into registration with each other.

12. An impact press according to claim 11, including a second peripheral groove on said ram, a second retainer means in said second groove, and a second inner peripheral groove on said locking ring, said ram grooves being simultaneously registrable with said ring grooves.

13. An impact press according to claim 11, said retainer means including a ring movable into said groove on said ram and balls movable into said groove on said locking ring.

14. An impact press according to claim 11, said retainer means including pairs of balls, one ball of each pair being movable into said ram groove, and the other ball of each pair being movable into said locking ring groove.

15. An impact press according to claim 14, including spacer pins disposed between the balls of each pair.

16. An impact press according to claim 11, including spring means acting between said sleeve and said locking ring and providing a bias.

17. An impact press according to claim 11, including a helical compression spring acting between said sleeve and said ram, said ram being rotatable within said sleeve and said locking ring being rotatable on said sleeve, said helical compression spring imparting an increment of rotation to said ram during its expansion, said retainer means consisting of balls, and the rotation of said ram acting frictionally through said balls imparting an increment of rotation also to said locking ring.

18. An impact press according to claim 4, said driving and actuating means including:

(a) a drive shaft rotatably supported on said frame and connected to reciprocate said sleeve; and (b) an eccentric drive clamped to said drive shaft at a selected position with respect to the rotational axis of said drive shaft and forming a part of the means for actuating said releasing means.

19. An impact press according to claim 18, said releasing means including a control shaft rockably carried on said frame, at least one release arm extending radially therefrom for coacting with said retaining means, a drive arm adapted to rock said control shaft in response to the axial position of said sleeve, and said drive arm being driven by said eccentric drive.

20. An impact press according to claim 4, said retaining means including a locking ring slidably carried on said sleeve and adapted to control release of said ram; and said driving and actuating means including a control shaft rockably carried on said frame, at least one release arm extending radially therefrom and engageable with said locking ring for shifting it in an axial direction on said sleeve, and a drive arm adapted to rock said shaft in response to the axial position of said sleeve.

21. An impact press according to claim 20, including means for effectively disconnecting one of said arms.

22. An impact press according to claim 20, including a solenoid-actuated pin carried by said drive arm, said pin being selectably retractable to inhibit release of said ram.

* * * * *